US005080274A

United States Patent [19]

Shea et al.

[11] Patent Number: 5,080,274

[45] Date of Patent: Jan. 14, 1992

[54] STAPLER HEAD HAVING WIRE PATH DEFINING COVER

[75] Inventors: Robert H. Shea, Victor; Steven M. Russel, Pittsford, both of N.Y.

[73] Assignee: Eastman Kodak Company, Rochester, N.Y.

[21] Appl. No.: 607,929

[22] Filed: Nov. 1, 1990

[51] Int. Cl.[5] ..... B27F 7/21

[52] U.S. Cl. ..... 227/90; 227/87; 227/131; 227/139; 227/155

[58] Field of Search ..... 227/87, 85, 88, 89, 227/90, 91, 92, 131, 139, 155

[56] References Cited

U.S. PATENT DOCUMENTS

| | | | |
|---|---|---|---|
| 2,865,021 | 12/1958 | Marzili | 227/89 |
| 3,917,145 | 11/1975 | Graf et al. | 227/88 |
| 4,770,334 | 9/1988 | Hoshi et al. | 227/85 |

*Primary Examiner*—Douglas D. Watts
*Assistant Examiner*—C. D. Dexter
*Attorney, Agent, or Firm*—Tallam I. Nguti

[57] ABSTRACT

A stapling apparatus using continuous staple wire for stapling a set of sheets includes a stapler head having a cover thereto that partially and advantageously defines the stapel wire path therein so as to substantially reduce staple wire jams and misfeeds.

6 Claims, 5 Drawing Sheets

STAPLER HEAD HAVING WIRE PATH DEFINING COVER

CROSS-REFERENCE TO RELATED APPLICATIONS

This application is related to the following applications filed on even date herewith:

1. U.S. application Ser. No. 608,098, filed in the names of Robert H. Shea et al and entitled "STAPLING SYSTEM WORK CLAMP."
2. U.S. application Ser. No. 608,116, filed in the names of Robert H. Shea et al and entitled "STAPLING SYSTEM HAVING NOISE REDUCING WORK CLAMP."
3. U.S. application Ser. No. 607,927, filed in the names of Robert H. Shea et al and entitled "STAPLING SYSTEM FEED MECHANISM."
4. U.S. application Ser. No. 607,930, filed in the names of Robert H. Shea et al and entitled "STAPLING SYSTEM HAVING A HYBRID CLINCHER ASSEMBLY."

BACKGROUND OF THE INVENTION

1. Field of the Invention

This invention relates in general to stapling apparatus, and more particularly, to a stapling apparatus that includes a stapler head having a staple-material path defining cover.

Electrostatographic copiers and printers for example are well known for producing a series of pre-collated image-bearing sheets which can then be compiled by an attached finisher portion thereto into a stack for binding together. As disclosed in commonly assigned U.S. Pat. No. 4,318,555 issued Mar. 9, 1982 in the name of Adamski et al, the use of a stapling system or apparatus to effect such binding is well known.

Typically, such a stapling apparatus utilizes either preformed staples, or a continuous supply of staple material, such as staple wire, from which a desired length thereof can then be cut for forming into a staple. Generally, for stapling copy sheets in copiers and printers, a stapling apparatus utilizing a continuous supply of staple material is preferred because it can be more versatile, more economical, and more efficient than a similar apparatus utilizing preformed staples.

Unfortunately however, in stapling apparatus which utilize a continuous supply of staple material such as staple wire, such staple material may vary in strength from relatively soft to relatively hard and springy, depending on the work piece to be stapled. For hard springy staple material or wire, conventional stapling apparatus as disclosed, for example, in U.S. Pat. Nos. 4,369,908 and 4,318,555 typically employ thick heavy-duty internal members in the stapler head for shearing such material, as well as for forming and driving staples therefrom. Such thick, heavy-duty internal members undesirably take up, as well as, require a lot of room for movement within the stapler head. As a consequence of such room taken up by the internal members, the spacing between the cover and base of the stapler head is usually many times greater than the thickness or diameter of the staple material. Reverse radius curvatures, recesses or grooves therefore have to be machined at the tips of such internal members in order to help define a staple-material path within the stapler head. Such machining is of course expensive, but more importantly, there can be misalignment between the machined grooves or recesses, and other fixed portions of a staple-material path in the stapler head.

In addition, hard and springy staple material is usually supplied coiled or wound about a spool from which it can then be removed peacemeal by pulling on a leading end thereof. Normally, depending on the hardness or springiness of the staple material, variations in the sizes of different spools, and variations in the amount and diameter of the winding, unfortunately tend to undesirably create semi-permanent curls in the staple material. Such curls in the staple material are undesirable because they tend to cause jams and misfeeds within the stapler head for example, particularly where there may be misalignment in the staple-material path therein.

Conventional stapling apparatus which include thick heavy-duty internal members as described above therefore must employ a staple material straightener that attempts to reverse, and hence to remove the curl therein. Alternatively, the size of staple material spools, and the amounts of staple material windings thereon must be carefully restricted in order to minimize variations in such curls, and hence to minimize the likelihood of the jams and misfeeds they cause. It has been found that the use of thick heavy-duty staple forming and driving members, with hard springy staple wire, imposes severe and costly restrictions on such a stapling apparatus, as well as, that despite such restrictions misfeeds and jams still occur.

SUMMARY OF THE INVENTION

It is an object of the present invention to provide a simple, versatile and economical stapling apparatus which can effectively handle straightened and unstraightened staple wires of varying hardness and springiness.

It is another object of the present invention to provide a relatively inexpensive stapling apparatus which can effectively handle continuous staple wire on a spool regardless of the size of the spool, and regardless of the amount of wire winding thereon, with substantially little risk of jams and misfeeds.

In accordance with the present invention, a stapling apparatus is provided for stapling a set of sheets together. The stapling apparatus includes a stapler head having a base, a cover, means for holding a formed staple, and a ram member for driving the formed staple through a set of sheets. The stapler head also has means for shearing a predetermined length of continuous staple material fed thereinto, and former members for forming the predetermined length of staple material into a staple. The stapler head further has means, including a staple material path, for receiving the predetermined length of staple material. The staple material path is defined in part directly by the base and the cover of the stapler head, and the path has a stapler-head base-to-cover dimension that is substantially equal to the thickness of the staple material to be received.

BRIEF DESCRIPTION OF THE DRAWINGS

In the detailed description of the invention presented below, reference is made to the accompanying drawings, in which.

DETAILED DESCRIPTION OF THE INVENTION

Figure 1:
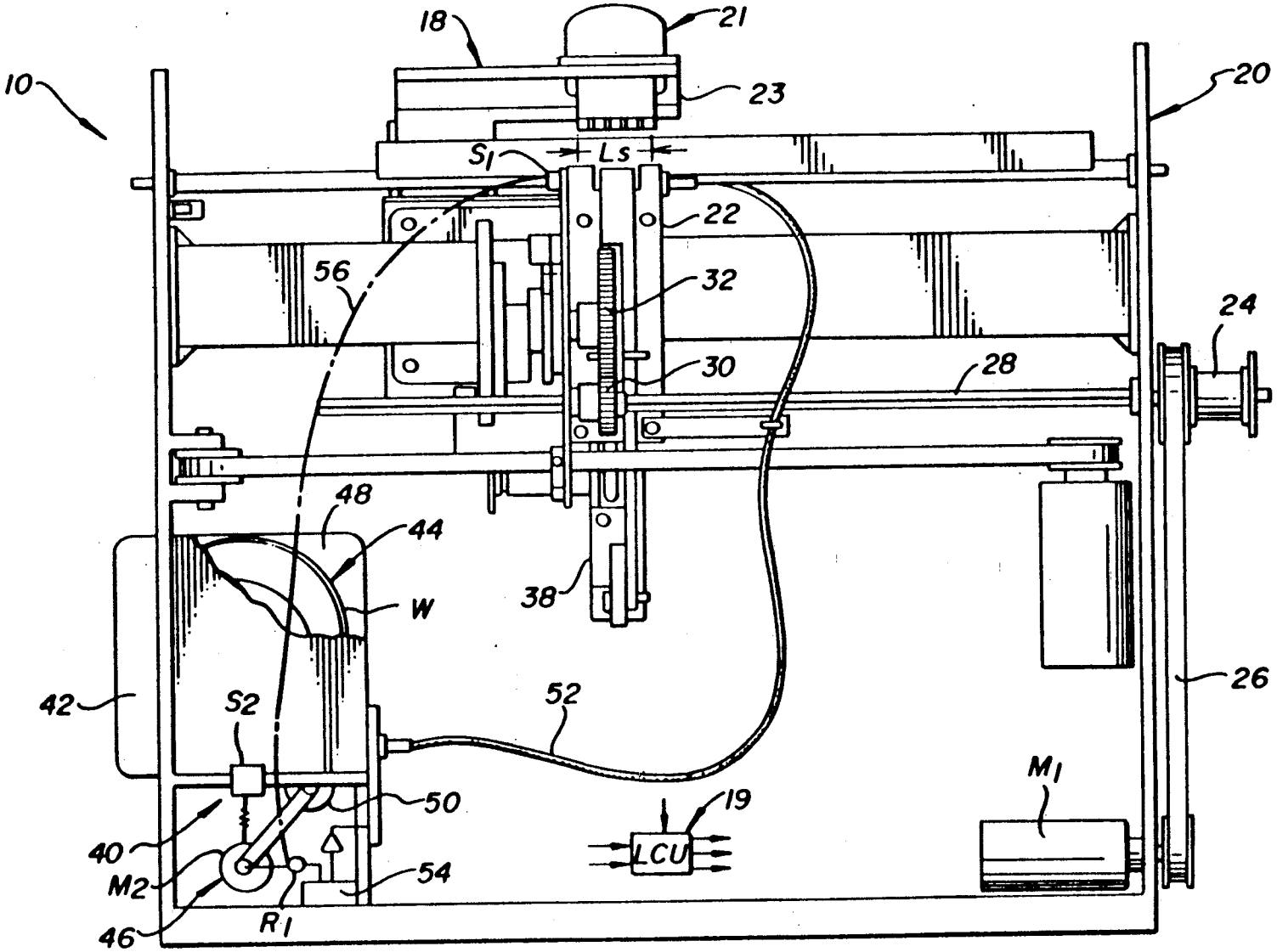
FIG. 1 is an end elevational view of the finisher portion of an electrostatographic copier or printer including the stapling apparatus of the present invention.
Figure 2:
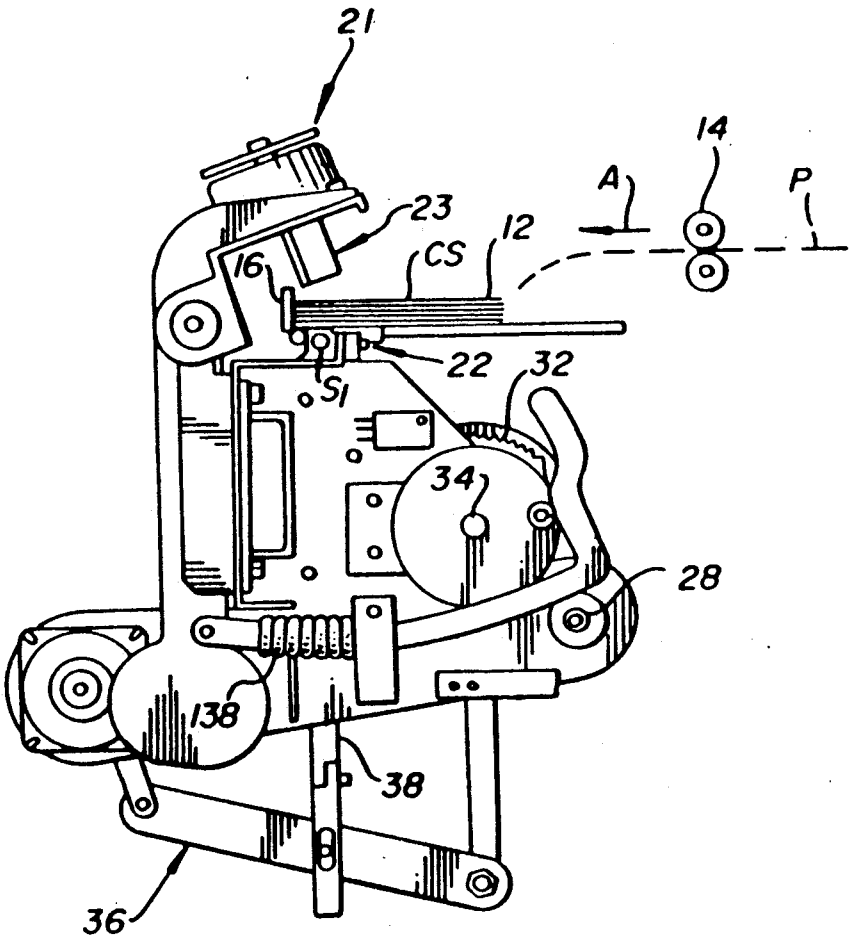
FIG. 2 is a front elevational view of the stapling mechanism of the present invention.

Referring now to FIGS. 1 and 2 of the accompanying drawings, the finisher portion of an electrostatographic copier or printer is designated generally as 10. The finisher 10 is located relative to a receiving tray 12 that is positioned to accumulate copy sheets CS from a copier or printer. The copy sheets CS, for example, are traveling in the direction of arrow A along a sheet travel path P. As shown, a transport mechanism, such as driven nip rollers 14, delivers the sheets CS seriatim to the tray 12. Each sheet is registered in the tray 12 along one of its edges against a pivotable gate 16, thereby compiling the sheets into a stack. The finisher 10 is positioned transverse to the travel path P, and includes a stapling apparatus 18 which is operatively associated with the registered edge of the sheets CS so as to be capable of binding such sheets together along such edge using staples.

As shown in FIG. 1, the stapling apparatus 18 includes a logic and control unit 19 for controlling the operation thereof. The logic and control unit 19 includes, for example, a microprocessor which receives input and timing signals, for example, from the transport mechanism 14, and from other components of the finisher 10. Based on such signals, and on a program from the microprocessor, the unit 19 produces signals to control the operation of the finisher 10, and that of the stapling apparatus 18.

Figure 3:
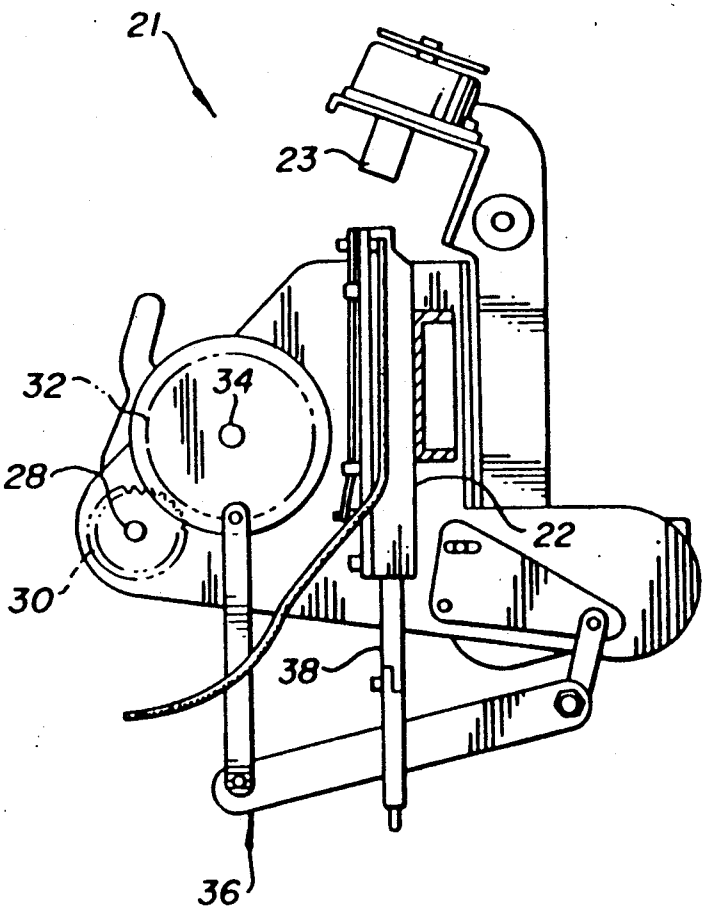
FIG. 3 is a rearside elevational view of the stapling mechanism of FIG. 2.

Referring now to FIGS. 1-3, the finisher 10 includes a frame 20 on which the stapling apparatus 18 is supported. As shown, the stapling apparatus 18 utilizes a continuous supply of wire and comprises a stapling mechanism 21 which includes drive means such as a motor $M_1$, a stapler head 22, and a clincher head 23.

As shown, the main drive $M_1$ is coupled to the input of a one revolution clutch 24 through a drive belt 26. The output of the clutch 24 is attached to a hex drive shaft 28. An input gear 30 has a complimentary hex-shaped bore for receiving the shaft 28. The input gear 30 is thus mounted for rotation with the shaft 28. An output gear 32 mounted on a crank shaft 34 for rotation therewith is in mesh with the input gear 30.

Rotation of the crank shaft 34 drives a bell-crank linkage assembly 36 which is connected to a staple drive bar 38. The staple drive bar 38, as such, is slidably movable forwards and backwards within the stapler head 22 for effecting shearing, forming and staple driving functions thereof.

Referring particularly to FIG. 1, the stapling apparatus 18 further includes a continuous staple material feeding mechanism such as a wire feeding mechanism 40. The mechanism comprises means such as a remotely mounted cassette 42 for holding a continuous supply of staple wire W in coil 44, and means 46 for advancing a length of the wire W from the cassette 42. The cassette 42 is loaded simply by plugging it into a complimentary receiving chamber 48 which is formed in the frame 20 in a position conveniently and safely accessible to an operator. The feeding mechanism 40 further comprises means, including the LCU 19, and a first, full-feed wire sensor $S_1$ located within the stapler head 22, for controlling the wire advancing means 46 so as to stop such means 46 when a desired length Ls of staple wire has been fed into the stapler head 22.

As shown, the wire advancing means 46 includes a non-metering wire feed wheel 50 and a flexible wire conduit cable 52 which is connected to the stapler head 22 and to a portion of the frame 20. The cable 52 receives wire W from the cassette 42 and guides it to the stapler head 22. The wheel 50 is driven by drive means such as a motor $M_2$. The advancing means 46 also includes a switch $S_2$ connected to the motor $M_2$ for sensing the absence or presence of a cassette 42 within the chamber 48. Power for the motor $M_2$ is provided, for example, by a 24-volt source power supply 54 that is connected to the motor $M_2$ via a shut-off relay $R_1$. As shown, the relay $R_1$ is also connected by means 56 to the full-feed wire sensor $S_1$ located in the stapler head 22.

Figure 4B:
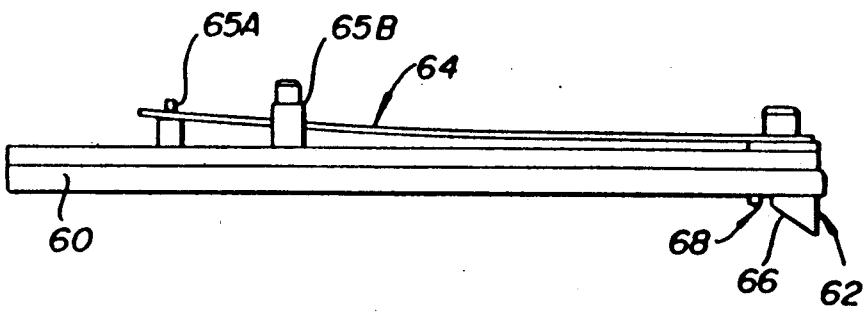
FIGS. 4A and 4B are top and side views of the stapler head of the present invention.
Figure 4A:
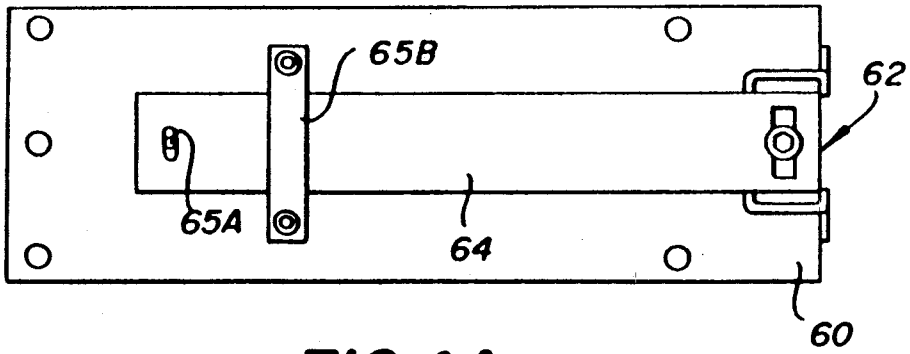
Figure 5:
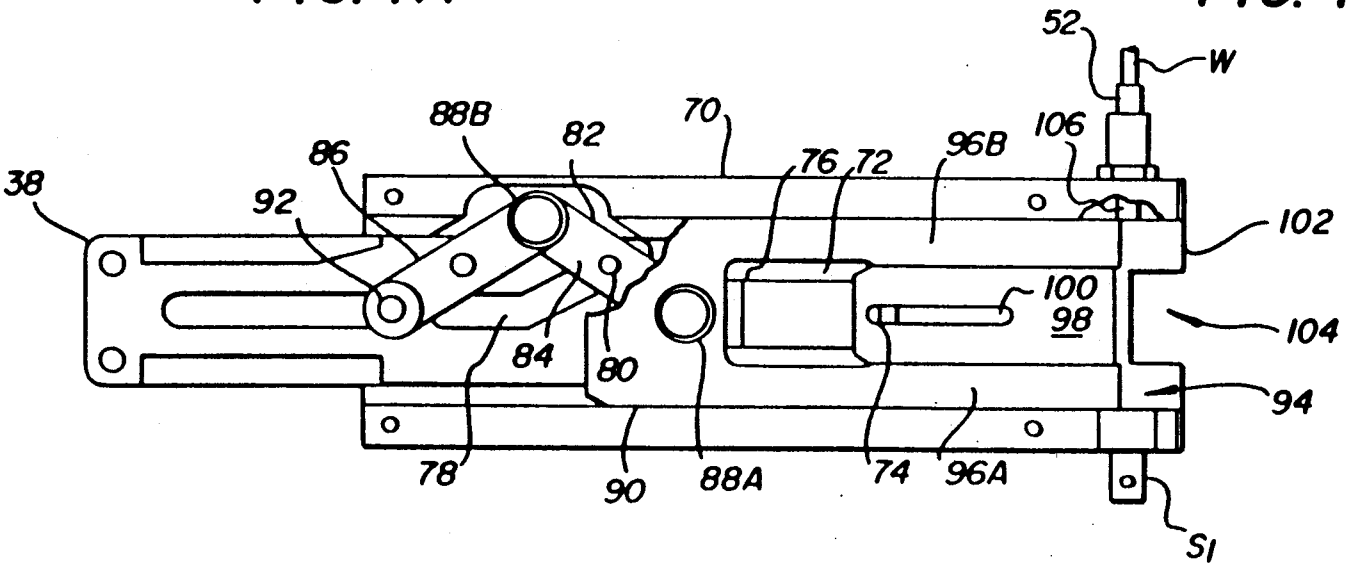
FIG. 5 is a top view of the stapler head of 4A, open and including cutaways for internal details.

As shown in FIGS. 4A, 4B and 5, the stapler head 22 includes a cover 60 which holds an anvil 62 by means of a leaf spring 64. The spring 64 is mounted at two points 65A, 65B towards its rear end so that the front end thereof which holds the anvil 62 can swing up and down about the point 65B according to the orientation of FIG. 4B. The anvil 62 includes a slant face 66 and a channel groove 68 therein.

The stapler head 22 further includes a base 70 over which the cover 60 is mounted, for example, by means of screws. Between the cover 60 and base 70, the drive bar 38, wire shearing means, a staple former, and a staple driving ram are movably linked in any one of several well known manners within suitable slots, and by means of pins. One such manner for example will be described herein in brief with respect to the present invention. The body 70 has a drop slot 72 which runs from the rear end of the base 70 and is wide enough to receive the staple drive bar 38 as shown, and in which the staple drive bar 38 is slidably moved. As moved by the bell-crank linkage assembly 36, the drive bar 38 has a frontward stroke, left-to-right according to FIG. 5, and a reverse rearward stroke. The portion of the drive bar 38 within the slot 72 includes a pin 74 at its forward end, and a raised portion 76 rearwards of the pin 74. The rearward end of the bar 38 is attached to the linkage assembly 36 as shown in FIGS. 2 and 3. Between the rearward end and the raised portion 76, the bar 38 further includes a cam slot 78 in which a movable roller pin 80 is captivated. Pin 80 forms a pivot point for a staple forming and driving linkage 82 comprising front and rear links 84, 86, respectively. Front link 84 is attached at its forward end by means of a pivot 88A to a staple former 90, and at its rearward end by means of a pivot pin 88B to the rear link 86. The other end of the rear link 86 is attached to a fixed pin 92 on a cross member at the end of a slot in the drive bar 38. This arrangement as is well known allows the linkage 82 to collapse or be extended within the base 70 as the drive bar 38 slides forwards and backwards within the slot 72.

The staple former 90 lies within, and is slidably movable forwards and backwards in a shallow slot 94 which opens from the deep slot 72 all the way to the front end of the base 70. As shown, the staple former 90 includes first and second narrow former legs 96A and 96B with a substantial spacing between them. The movement of the former 90 within the slot 94 is governed by the positions of the front and rear links 84, 86, respectively, the roller pin 80 within the cam slot 78, and ultimately by the position of the staple drive bar 38 within the base 70.

Within the spacing between the two former legs 96A, 96B, a staple driving ram 98 is nested. The ram 98 includes a slot 100 at its rear end within which the drive bar pin 74 slidably fits. As such, the pin 74 can slide forwardly within the slot 100 until the rear edge of the ram 98 strikes the raised portion 76 of the staple drive bar 38. This will occur during a full forward stroke of the bar 38. On the other hand, the ram 98 will be caught and moved backwards by the pin 74 during a full backward stroke of the bar 38. During most of the forward or backward stroke however, the slot 100 allows free movement of the ram 98 about the pin 74.

As shown in FIG. 5, with the drive bar 38 fully retracted into a backstroke, both the former legs 96A, 96B and the ram 98 will be pulled back into the shallow slot 94 away from the front end 102 of the base 70. The front end 102, as shown, includes a centered, reverse cutout 104 therein which is substantially the same width as the ram 98. The cutout 104 is such that when the cover 60 with the anvil 62 is assembled to the base 70, the anvil 62 will lie within the cutout 104 while making contact within the shallow slot 94 just frontwards of the retracted ram 98. The design is such that with the ram 98 and anvil in this position, there will be room on either side of the anvil 62 for the width of each former leg 96A or 96B and the diameter of the staple wire W.

Figure 6A:
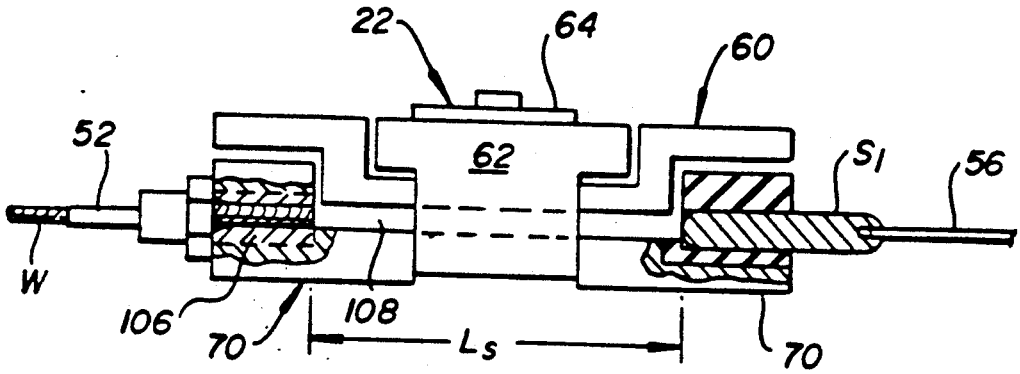
FIGS. 6A-6C are end views, partially cut out and sectioned for detail, of the stapler head of the stapling mechanism of FIG. 2.
Figure 6B:
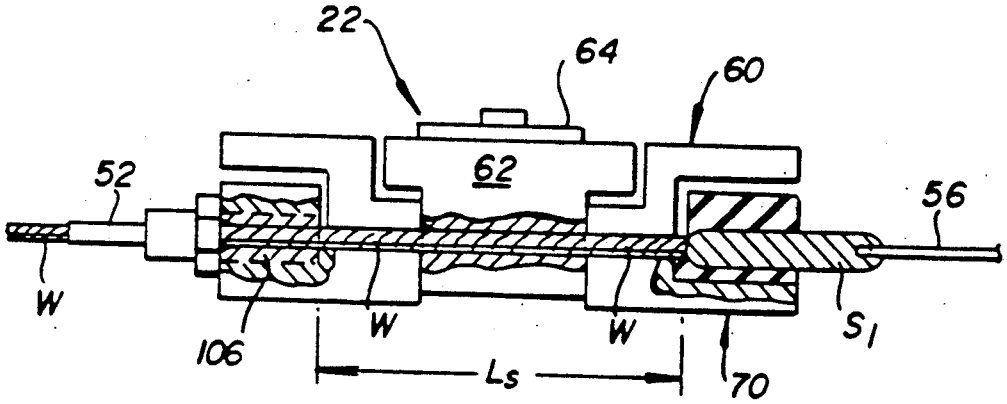

As further shown in FIG. 5, the staple wire W can be fed into and across the shallow slot 94 through a cylindrical opening to one side of the front portion of the base 70. The opening is formed by the flexible conduit cable 52 properly connected to the base 70, and by a hardened drill bushing 106 therein. The opening is such that the fully retracted ram 98 and former legs 96A, 96B lie immediately rearwards thereof. Together with the base 70, the anvil 62, the ram 98 and former legs 96A, 96B cooperate to form a generally cylindrical staple material path 108 (FIG. 6A) for receiving staple wire W across the shallow slot 94. On the other side of the slot 94 across from the bushing 106, is mounted the full-feed wire sensor $S_1$ for controlling the feeding of such wire W.

As is well known, the base of a stapler head as disclosed is the solid portion of the body of the stapler head that contains the various open slots through which move the linkage assemblies that include the staple drive bar, the staple former legs, and the staple driving ram. On the other hand, as it is also well known, the cover of a stapler head as disclosed is the portion of such a stapler head that fits over the linkage assemblies in the base, thereby enclosing the various slots. The linkage assemblies, as is also known, therefore are movable back-and-forth between the base and cover. The cover as such is typically spaced from the base by the thickness of the components of the linkage assemblies.

According to the present invention, the stapler head 22 is capable of handling straightened and unstraightened staple wire W, being fed thereinto, regardless of the hardness and springiness of such wire. The stapler head 22 is capable of doing so with substantially little or no risk of wire misfeeds and jams. Accordingly, the cylindrical wire path 108 (FIG. 6A) across the flat surface area as shown of shallow slot 94 is made to have a base-to-cover dimension, or diameter substantially equal to the diameter or thickness of the wire W. A clearance factor of plus five (+0.005) mils is allowed. In order to make the base-to-cover dimension or diameter of the path substantially equal to that of the wire plus clearance, the thickness of each former leg 96A, 96B, and that of the ram 98, are made substantially equal to the diameter of the wire W. The former legs 96A, 96B, and ram 98 are therefore very thin, and consequently operate to space the cover 60 from the base 70 only by such diameter of the wire W. The staple material receiving path 108 is therefore defined directly by flat and ungrooved tip ends as shown of the retracted former legs 96A, 96B and ram 98, and importantly in the base-to-cover direction, directly by the base 70 and the cover 60. The anvil 62 with the groove 68 therein also serve to define the path 108 within the cutout 104.

Because the stapler head cover 60 directly defines the path 108, there is no need in the stapler head of the present invention to machine costly path defining grooves or recesses in the tip ends of the former legs 96A, 96B or that of the ram 98 which contact and push against the length of wire Ls within the stapler head 22. Additionally, there is no risk of misalignment of such absent recesses or grooves with any fixed portion of the wire path, for example, the bushing 106 as shown.

As shown in FIGS. 6A–7B, staple wire W fed through the cable 52 and bushing 106 will be received in the path 108 (see FIG. 6B) until a length Ls lies across the shallow slot 94. As received, the length Ls will be completely restricted on two sides by opposing flat surface areas of the base 70 and cover 60 while moving across the slot 94. The length Ls will also be restricted on a third side by the former legs 96A, 96B and ram 98. Within the cutout 104, the length Ls will be further restricted on a fourth side by the anvil 62, as shown in FIG. 6B. As a result, straightened and unstraightened lengths Ls of continuous staple wire W can be received into the stapler head 22 through the path 108 without significant risks of jams. During such feeding, there is absolutely no room for wire play in the base-to-cover direction or in the rearward direction therein against the former legs and the ram. There is also no alignment necessary of any path portions, such as ram and former leg recesses.

The anvil 62 also functions to prevent play in the forward direction therein. The wire-feed side opening into the groove 68 in the anvil 62 is flared so as to accommodate any possible single-(frontward)-direction play of the lead end of the length Ls when being fed from the bushing 106 to the groove 68. This distance between the bushing 106 and groove 68 is normally less than one quarter the length Ls, and has been found to allow little or no play beyond what can be accommodated by a mere flaring of the entrance into the groove 68. Straightened and unstraightened wire of varying hardness, and without spool and winding size restrictions, can therefore be fed into and used by the stapler head 22 without significant risks of jams and misfeeds.

Figure 6C:
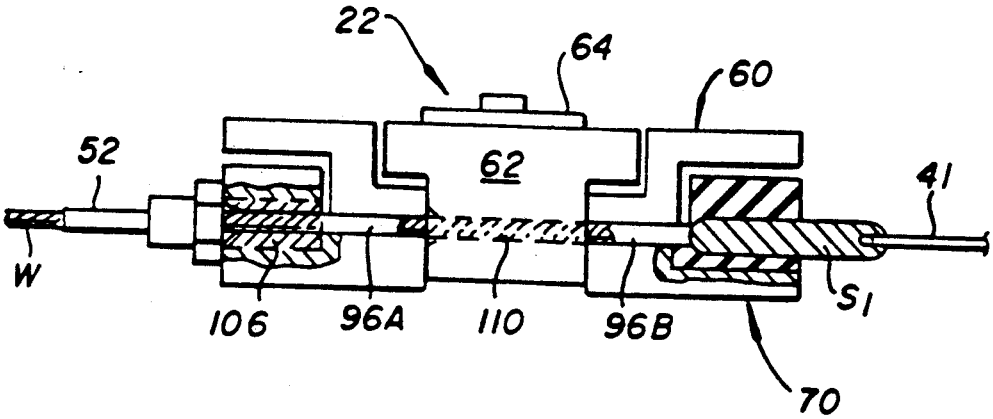
Figure 7A:
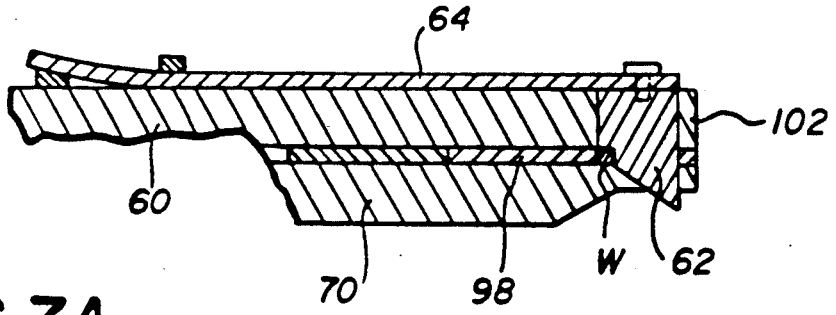
FIGS. 7A-7B are side sectional views of the stapler head of FIG. 4A.
Figure 7B:
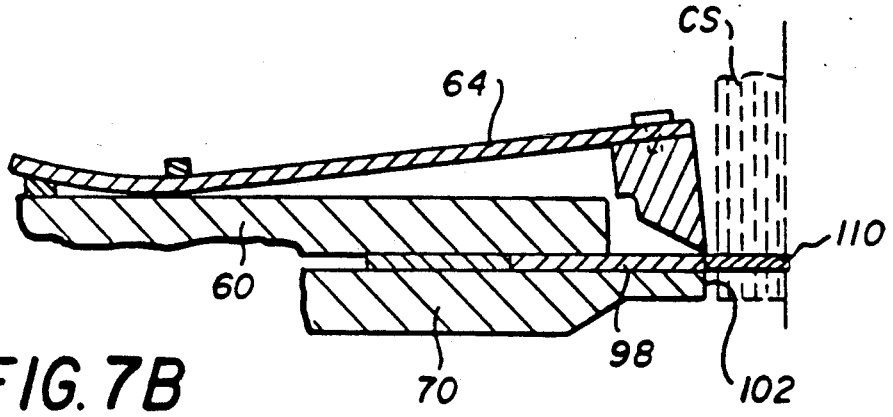

When fully received as such into the stapler head 22 so that the lead and free end of the length Ls barely makes electrical contact with the sensor $S_1$, the length Ls thereafter can be sheared at the bushing 106 by the former leg 96A as shown in FIG. 6C, and then formed into a staple 110 about the anvil 62. Once formed, the staple 110 can then be driven by the ram 98, on a full forward stroke, into a set of sheets CS.

The ram 98, in addition to driving the staple 110, also serves to displace or space the anvil 62 from the base 70 of the shallow slot 94 during the entire staple driving function. Because the thickness of the ram 98 is substantially equal to the diameter of the wire W, the anvil 62 will therefore remain in constant contact with the staple 110 until it is completely driven between the base 70 and cover 60 forwardly past the front end 102 of the stapler head 22, and into the set of sheets CS. Because the tip end of the ram 98 contacting and driving the staple 110 can be flat, the crown of the staple 110 will therefore be driven fully beyond the end 102 of the base 70 which rests on the sheets CS. The result is a more effective binding of the sheets CS by such staple 110.

As can be seen, the stapler head 22 of the present invention is simple, versatile and economical since it can handle staple wire of varying hardness and springiness without need of straightening, and since it can do so without costly restrictions as to wire spool size or amounts of wire windings on such spools. Additionally, a wire path defined directly by the stapler head base and cover enables the use of flat tip end rams and former legs which are thin and can be less costly to produce.

The invention has been described in detail with particular reference to presently preferred embodiments, but it will be understood that variations and modifications can be effected within the spirit and scope of the invention.

What is claimed is:

1. A stapling apparatus for stapling a set of sheets together, the stapling apparatus comprising:

(a) a wire feed mechanism for feeding a length of staple wire from a continuous supply of such wire, such staple wire having a predetermined diameter; and (b) a stapling mechanism having a stapler head, said stapler head including a base having a first flat surface area thereacross, a cover having a second flat surface area across and spaced from said first flat area of said base, means for driving a formed staple through such a set of sheets, means for shearing a predetermined length of staple wire and forming a staple therefrom, said wire shearing and forming means and said staple driving means being mounted for movement between said base and said cover, and means, including a wire path, for receiving into said stapler head said predetermined length of staple wire, said wire path in said stapler head having a diameter substantially equal to said predetermined diameter of the staple wire, and said wire path being defined directly by said first flat surface area of said base of said stapler head, by an ungrooved tip end of said staple driving means, by flat tip ends of said shearing and forming means, and by said second flat surface area of the cover of said stapler head.

2. A stapling mechanism for stapling a set of sheets together, the stapling mechanism including a stapler head having a base having a first flat surface area thereacross, a cover having a second flat surface area across and spaced from said first flat area of said base, means for holding a formed staple, a ram member having an ungrooved tip end for driving the formed staple through such a set of sheets, means for shearing a predetermined length of continuous staple material fed thereinto, former members having flat tip ends for forming a staple from said predetermined length of staple material, and means including a staple material path for receiving said predetermined length of staple material into said stapler head, said staple material path being defined in part directly by said first flat surface area of said base and said second flat surface area of said cover of said stapler head, and said staple material path having a base-to-cover dimension substantially equal to the thickness of the staple material to be received.

3. The stapling mechanism of claim 2 wherein the thickness of said staple driving ram member is substantially equal to the thickness of the staple material.

4. The stapling mechanism of claim 2 wherein the thickness of each said former member is substantially equal to the thickness of the staple material.

5. The stapling mechanism of claim 2 wherein said staple material receiving path is generally cylindrical, is for receiving staple wire, and has a diameter substantially equal to the diameter of the staple wire to be received.

6. The stapling mechanism of claim 2 wherein said base-to-cover dimension of said staple material path is equal to the thickness of said staple material plus 0.005 of an inch.

* * * * *